US007063620B2

(12) United States Patent
Nearhood

(10) Patent No.: US 7,063,620 B2
(45) Date of Patent: Jun. 20, 2006

(54) BILLIARD RACK LASER SYSTEM FOR POSITIONING A RACK FOR A BILLIARD GAME

(76) Inventor: Steven Nearhood, 809 E. Stroop, Dayton, OH (US) 45429

( * ) Notice: Subject to any disclaimer, the term of this patent is extended or adjusted under 35 U.S.C. 154(b) by 0 days.

(21) Appl. No.: 10/831,669

(22) Filed: Apr. 23, 2004

(65) Prior Publication Data

US 2005/0239566 A1 Oct. 27, 2005

(51) Int. Cl.
*A63D 15/00* (2006.01)

(52) U.S. Cl. ..... 473/2; 473/40

(58) Field of Classification Search ..... 473/1, 473/2, 19, 21, 22, 26, 40, 41
See application file for complete search history.

(56) References Cited

U.S. PATENT DOCUMENTS

| | | | | |
|---|---|---|---|---|
| 3,466,038 | A * | 9/1969 | Hill | 473/4 |
| 4,688,796 | A * | 8/1987 | Wright | 473/2 |
| 4,882,676 | A * | 11/1989 | Van De Kop et al. | 473/2 |
| 5,554,075 | A * | 9/1996 | Glazer | 473/2 |
| 5,559,639 | A * | 9/1996 | Nakagishi et al. | 359/823 |
| 6,609,307 | B1 | 8/2003 | Haynes et al. | |
| 6,629,897 | B1 * | 10/2003 | Belknap | 473/40 |
| 2004/0132535 | A1 * | 7/2004 | Sumko | 473/2 |

* cited by examiner

*Primary Examiner*—Mitra Aryanpour
(74) *Attorney, Agent, or Firm*—R. William Graham

(57) ABSTRACT

A billiard rack laser system for positioning a rack for a billiard game includes a pool table having an alignment mark and a pool rack having a laser operably connected thereto such that when the rack is placed on the table, the laser is equipped to illuminate a beam which when directed at the alignment mark illuminates the same thereby indicates a proper spot of the rack for positioning the same on the table.

9 Claims, 6 Drawing Sheets

Fig. 4
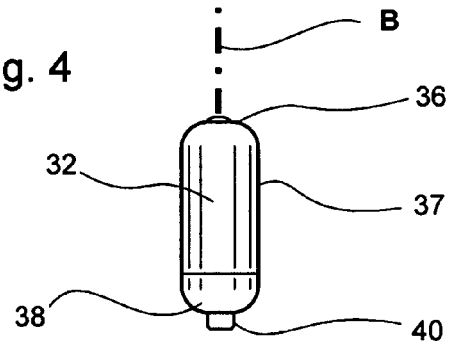
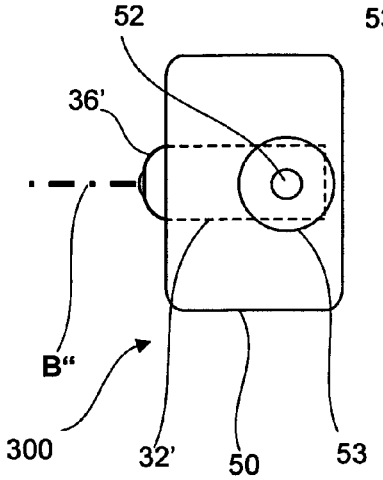
Fig. 5A
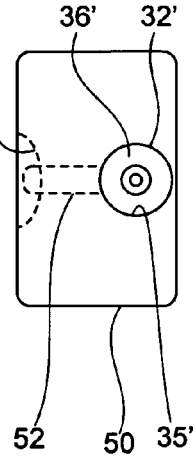
Fig. 5B
Fig. 3A
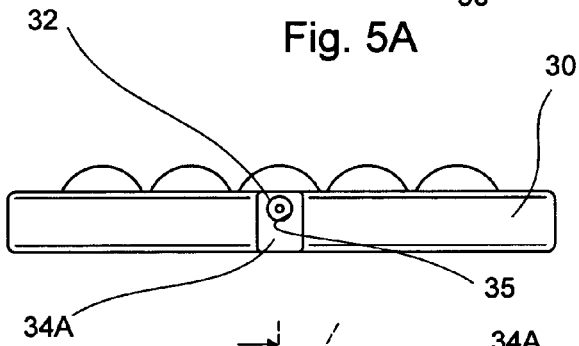
Fig. 2A
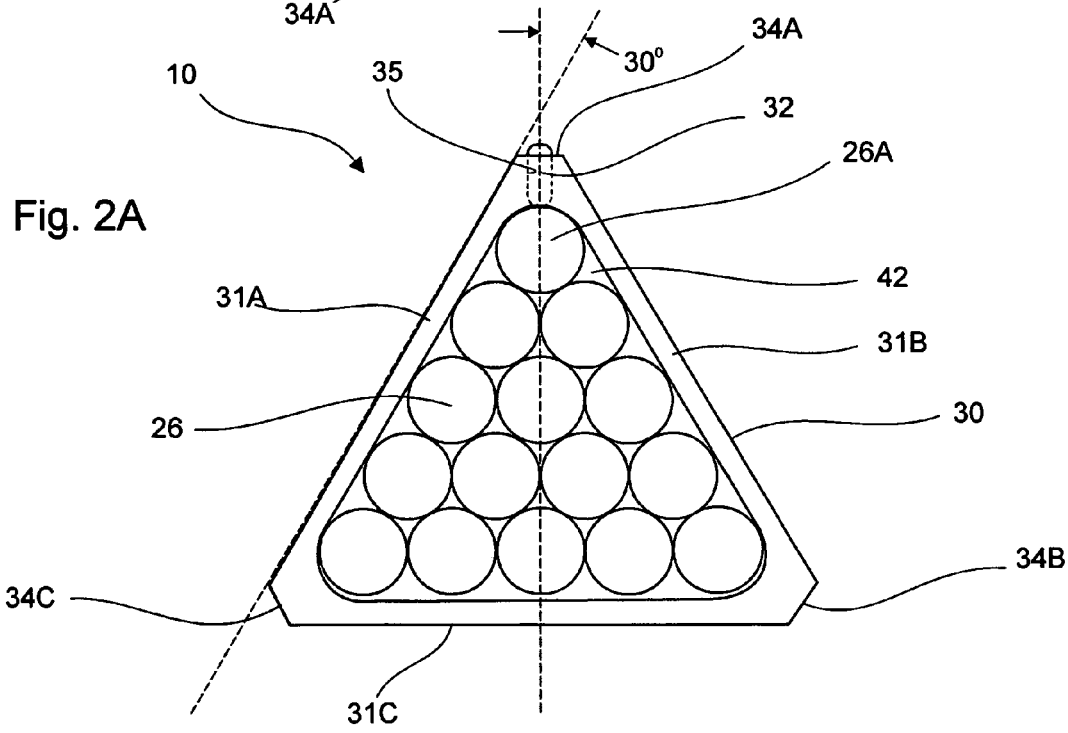

BILLIARD RACK LASER SYSTEM FOR POSITIONING A RACK FOR A BILLIARD GAME

BACKGROUND OF THE INVENTION

1. Field of the Invention

The present invention relates to the billiards. More particularly, the invention relates to an improvement in spotting a rack for billiards.

2. Related Art

Billiards requires the use of a table, set of billiard balls, cue ball, cue sticks, rack and bridge. Due to the competitive nature of the game of billiards, it is desired to have a repeatable and precise location of an initial rack. This precludes an unfair advantage for a player.

There is a need for providing a repeatable and precise initial rack for a billiard game. A typical billiard table includes a spot mark physically placed on the top surface of the playing table to identify the location of the placement of an initial rack. This mark is intended to coincide with the location of a lead ball inside the rack with the other playing balls disposed behind the lead ball within the rack.

The lead ball is placed on top of this spot mark and a remainder of the balls in the rack are positioned with respect to the placed lead ball by using the rack. The player making this initial break must do so with the cue ball located in a permitted area and without crossing a line, usually an imaginary line, on the playing surface during the break procedure. Once the balls are set, the rack is removed and the game is begun by placing a cue ball in the permitted area and driving the cue ball into the set balls using a cue.

The use of the existing spot mark on the playing surface and imaginary lines has proved to be an inadequate method of assuring a repeatable rack. The lead ball is typically not placed in the exact same point on the spot each time. Further, the rack may be slightly angled with respect to a proper alignment of the rack. As a result, the rack will affect the play of the balls upon the break of the balls. This is an undesirable result, particularly in competitive tournaments. The spot mark on the playing surface may affect the aesthetics of the playing surface and give some players an advantage in lining up a shot.

By providing a conventional spot mark on the table surface, the playing surface may tend to wear more at one end of the playing surface where the rack is always positioned. It is desirable to alternate play at both ends without there being any physical spot on the playing surface of the table.

There is a need for an improved racking system for a billiard game that does not require the use of a spot mark placed on or incorporated into the top playing surface of the billiard table. There is a need for a racking system which provides for an accurate and a repeatable rack of the billiard balls on the surface of a billiard table which aligns the rack as well as provides a temporary visual line onto the surface behind which the cue ball is disposed for purposes of an initial break.

SUMMARY OF THE INVENTION

It is an object to provide an accurate and repeatable racking of billiard balls for a billiard game.

It is another object to provide a racking system which does not require the use of a spot mark placed on or incorporated into a playing surface of the billiard table.

It is another object to provide racking system for an accurate and a repeatable rack of the billiard balls on the surface of a billiard table which aligns the rack as well as provides a temporary visual line onto the surface behind which the cue ball is disposed for purposes of an initial break.

It is another object to provide a racking system which does not interfere with the overall aesthetics of the table.

Accordingly, the present invention is directed to a racking system, which includes a pool table having an alignment mark on a side of the table; and a pool rack having a laser operably connected thereto such that when the rack is placed on the table, the laser is equipped to illuminate a beam which when directed at the alignment mark illuminates the same thereby indicating a proper spot of the rack for positioning the same on the table. The laser can be activated by a biasing element wherein a ball within the rack touches the element to cause the illumination of the laser beam. The rack can include one or more lasers in conjunction with one or more alignment marks on the table.

The laser can include a beam splitter thus providing a line across the width of the table to divide the table into areas where the balls are on one side a cue ball on another for the initial break. The laser beam(s) will be visible during the set up of the rack so placement of the rack will be accurate and repeatable and permit the cue ball to be positioned. Once the rack is removed from the balls, the laser is deactivated.

These and other objects are achieved by the racking system will be apparent from the following drawings and description hereinafter.

BRIEF DESCRIPTION OF THE DRAWINGS

FIG. 2A is a top view of a rack used in the present invention.

FIG. 3A is a front view of the rack in FIG. 2A.

FIG. 4 is a laser which is employed in the rack of the invention.

FIG. 5A is top view of another laser employed in the invention.

FIG. 5B is a front view of the laser in FIG. 5A.

DETAILED DESCRIPTION OF THE INVENTION

Figure 1A:
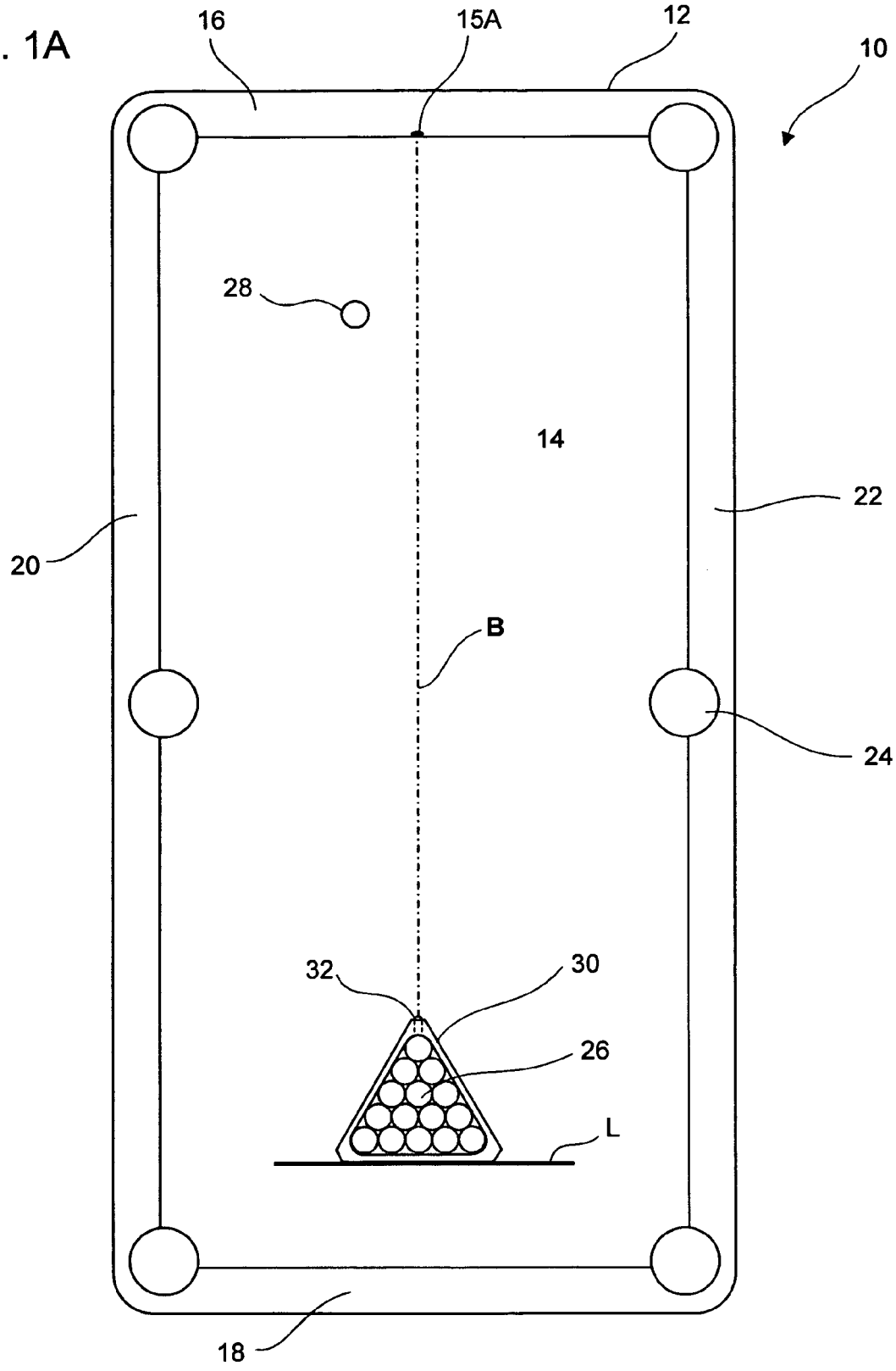
FIG. 1A is a top view of a racking system of the present invention.

Referring now to the drawings, the racking system of the present invention is generally referred to the numerals 10, 100, and 200. The racking system 10 includes a table 12 for playing a billiard-type game having a playing surface 14 having a first end 16, a second end 18, a first side 20 and a second side 22. The table 12 includes pockets 24. Alignment mark 15A can be oriented on the end 16, for example, half way between the sides 20 and 22. A plurality of billiard-type balls 26 and a cue ball 28 are included.

The racking system 10 includes a rack 30. Operably disposed within the rack 30 is a laser 32. The laser 32 can preferably be disposed within an end 34A of the rack 30 in a manner such that a beam emitting end 36 faces outwardly from the rack end 34A such that when the laser 32 is turned on, a beam B is emitted at a 30° angle with respect to a side 31A of the rack 30.

The laser 32 has an activating end 38 which includes a spring loaded switch 40. When the laser 32 is operably disposed within a bored surface 35 of the end 34A, the switch 40 extends into an area 42 confined by sides 31A, 31B and 31C. A lead ball 26A can be forced in to contact with the switch 40 causing actuation thereof and thus the emission of the beam B. Optionally, one or more line(s) L can be fixably disposed on the table surface 14. The Line L is intended to serve as an alignment aid for the back side 31C of the rack 30. Thus, together with the emitted beam B directed at the alignment marking 15A, an accurate and repeatable racking can occur each time.

Figure 1B:
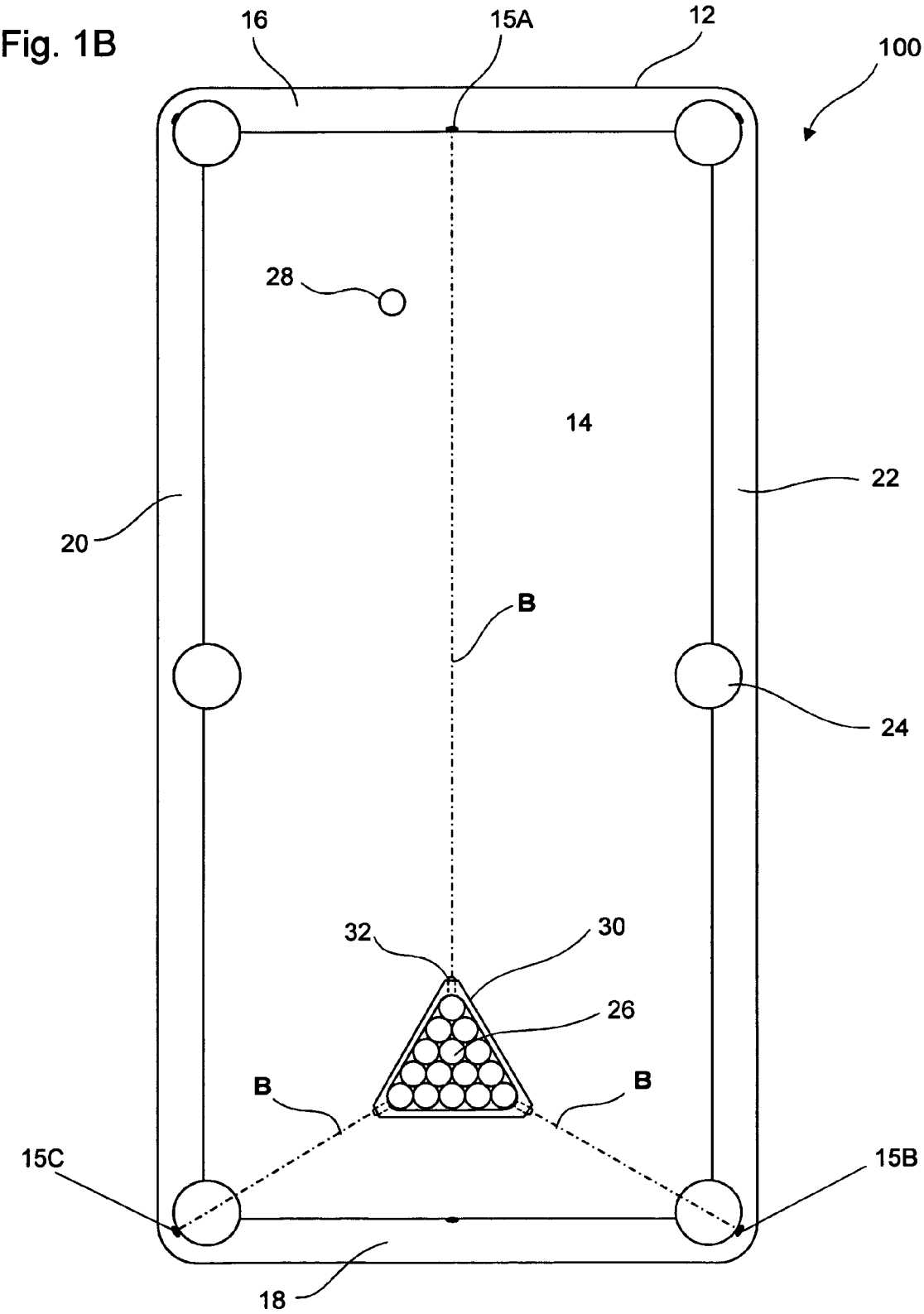
FIG. 1B is a top view of another embodiment of a racking system of the present invention.
Figure 2B:
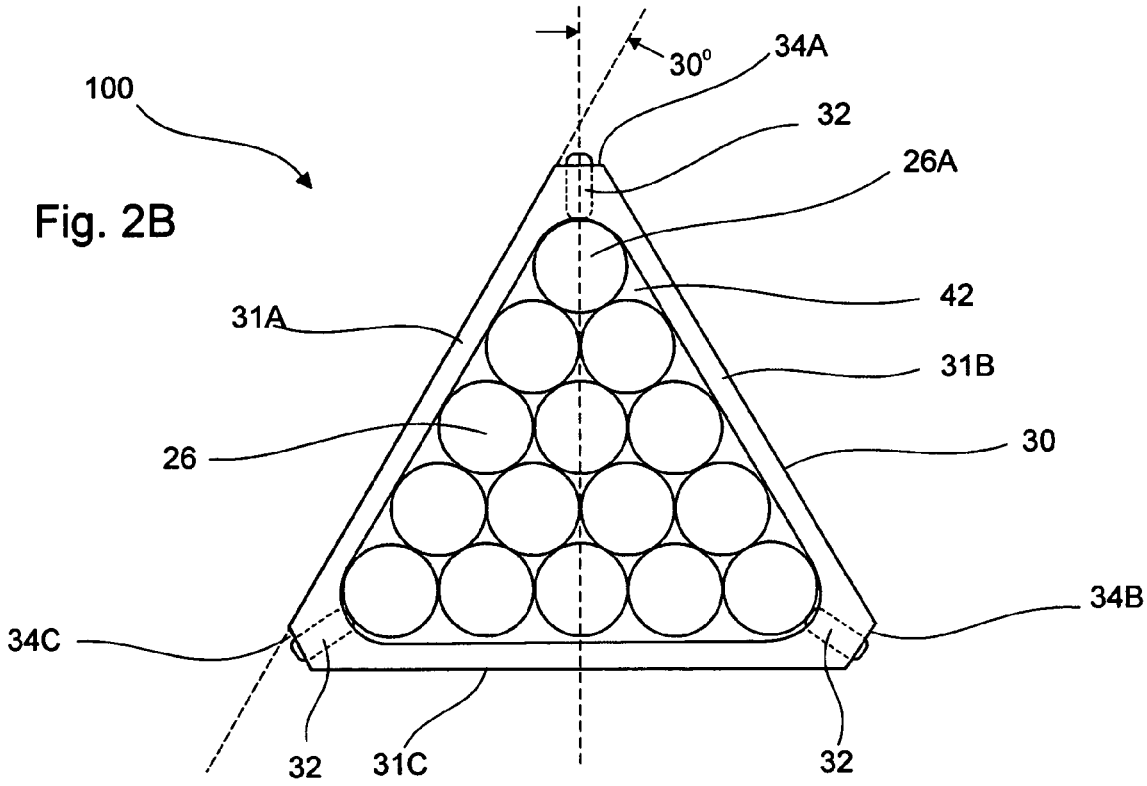
FIG. 2B is a top view of another rack used in the present invention.

FIGS. 1B and 2B illustrates another embodiment 100 wherein, multiple lasers 32 can be incorporated into ends 34A, 34B and 34C. In this instance, alignment markings 15A, 15B and 15C can be provided on the table 12 as shown, for example, to effect a proper alignment.

Figure 1C:
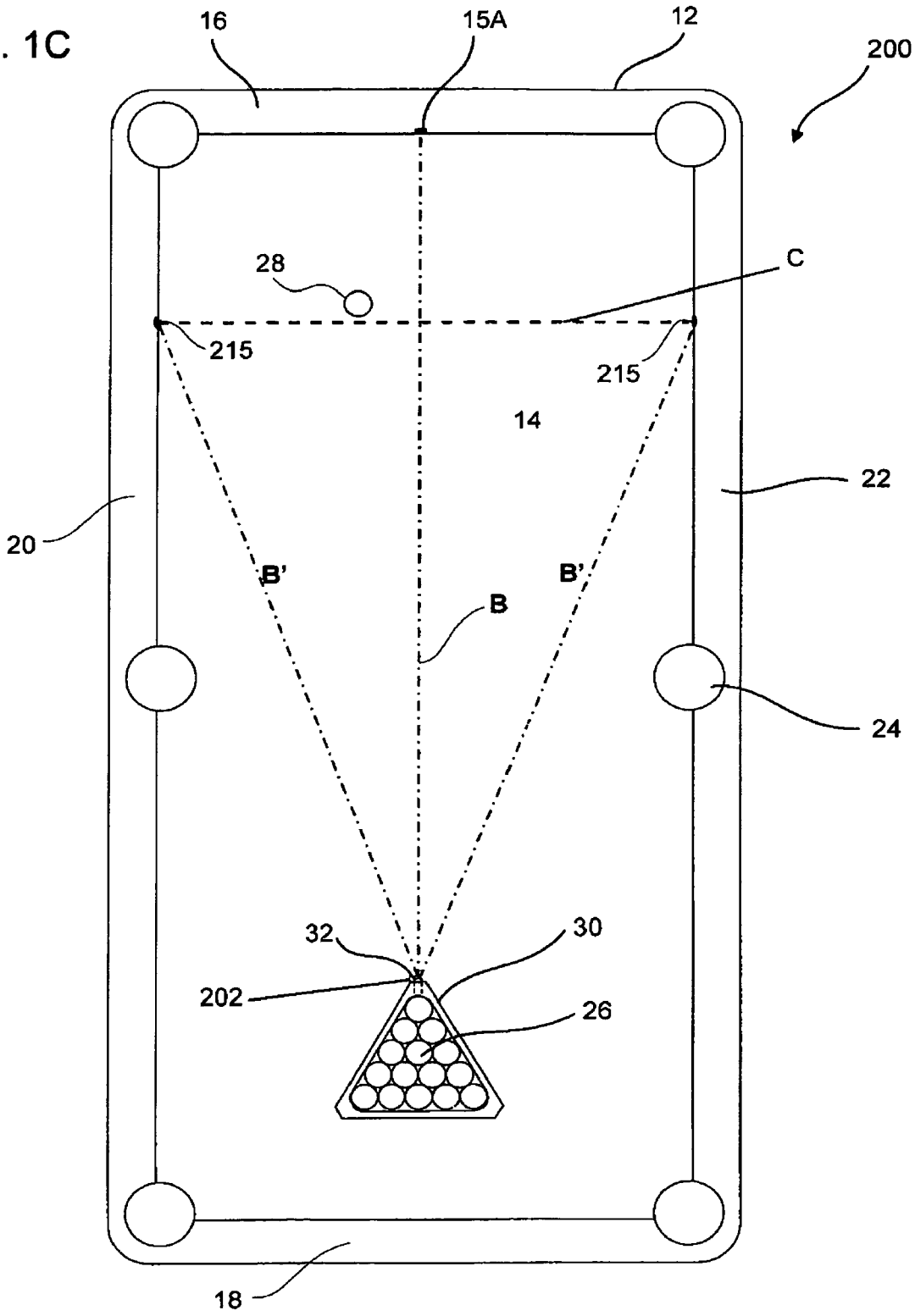
FIG. 1C is a top view of yet another embodiment a racking system of the present invention.
Figure 2C:
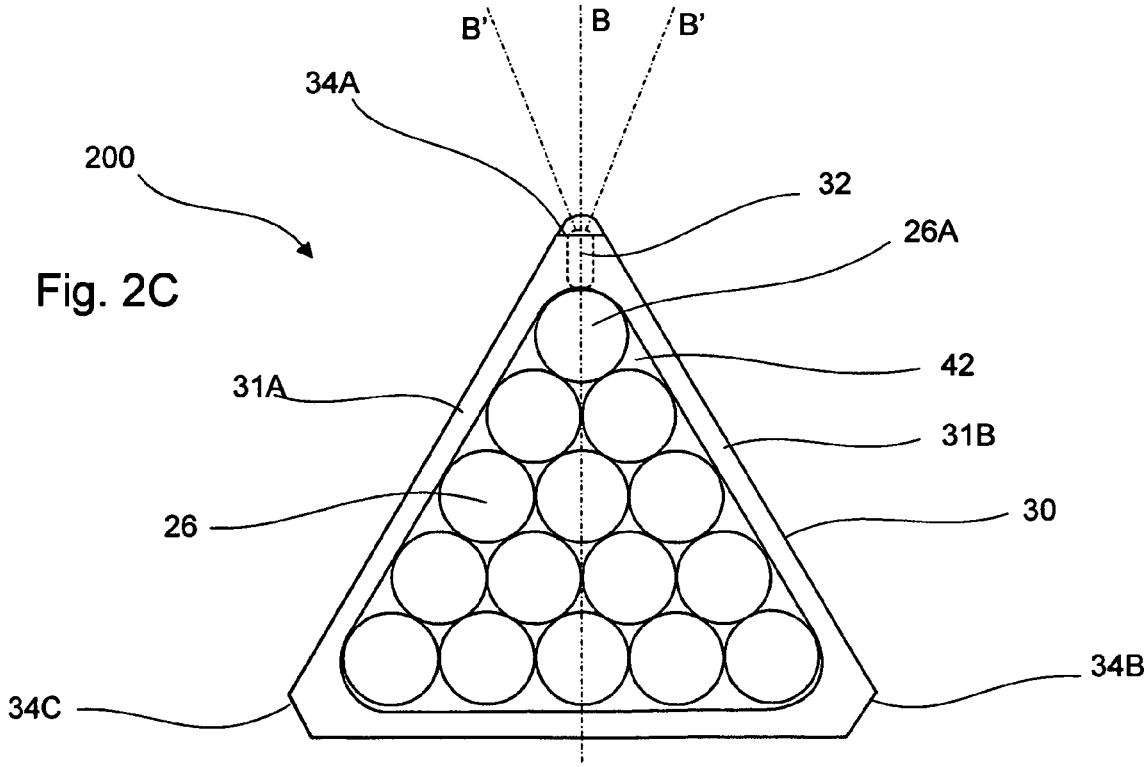
FIG. 2C is a top view of still another rack used in the present invention.

Still another embodiment 200 seen in FIGS. 1C and 2C can include a beam splitter 202 which provides for a plurality of beams B and B' to be used on marks 215 to perfect alignment. In this instance, part of the beams B' can be used to define a cue line C such that the cue ball may be placed for starting the game.

The laser 32 can include circuits and lenses known to the art and can be incorporated into a housing 37 which is configured to fit within the bored surface 35. It is understood that the laser 32 includes a power source, such as battery, operably disposed within the housing 37. It is understood that while certain forms of the present invention have been illustrated and described herein, it is not to be limited to the specific forms or arrangements of parts described and shown.

Figure 6:
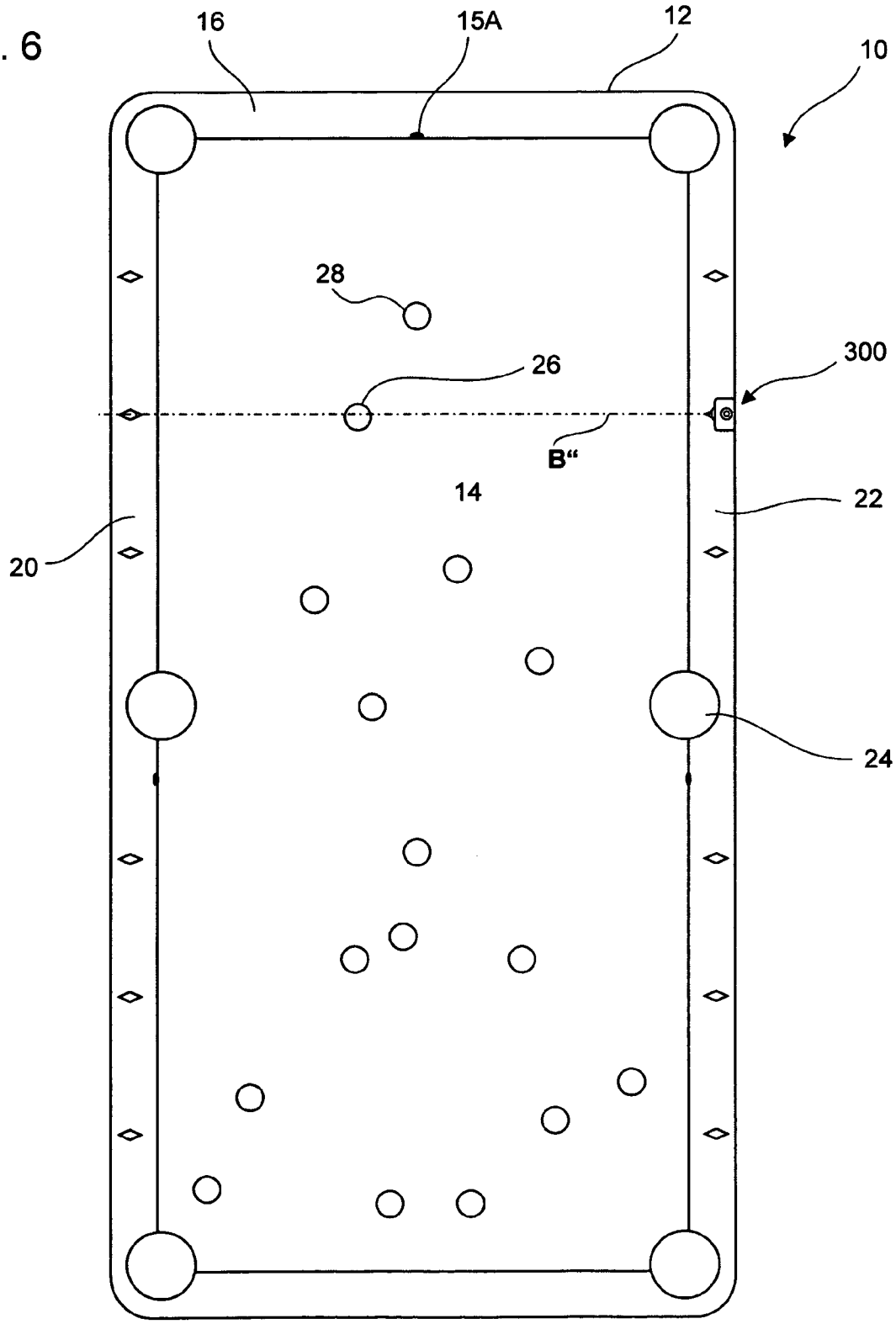
FIG. 6 is a top view of illustrating another embodiment of the present invention.

FIG. 6 illustrates another embodiment 300 of the invention, wherein a laser 32' is disposed within a housing 50 which can be provided on one side 22, for example, of the table 12. The laser 32' can be activated by a switch 52 which extends through an opening 53 of the housing 50, wherein a beam B" can be illuminated from an end 36' of the laser 32' across the marks 215 for purposes of aligning cue ball 28 on an initial break or in the event of a scratch.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A billiard rack laser system for positioning a rack for a billiard game, which includes:

a pool table having an alignment mark; and a pool rack having a plurality of sides defining an inner area for containing a plurality of billiard balls and having a laser operably connected thereto such that when said rack is placed on said table, said laser is equipped to illuminate a beam which when directed at said alignment mark illuminates said mark thereby indicating a proper spot for said rack in order to position the same on said table and wherein said rack includes a bored surface extending from one side through to another side of said rack to receive said laser therethrough, said laser having biasing means extending inward into said inner area of said rack which is biased inwardly by a billiard ball upon insertion of billiard balls into said rack thereby activating said laser such that said beam can illuminate outwardly from said rack and when said balls are removed from said rack said beam is automatically shut off by virtue of said biasing means relaxing to an off position within said inner area.

2. The billiard rack laser system of claim 1, wherein said alignment mark is on a side of said table.

3. The billiard rack laser system of claim 1, wherein said rack includes multiple lasers emitting a plurality of laser beams for positioning said rack.

4. The billiard rack laser system of claim 3, further includes a plurality of alignment marks on said table used in conjunction with said beams.

5. The billiard rack laser system of claim 1, wherein said bored surface extends through a corner of said rack.

6. A billiard rack for use with a pool table having an alignment mark, which includes:

a pool rack having a plurality of sides defining an inner area for containing a plurality of billiard balls and having a laser operably connected thereto such that when said rack is placed on the pool table, said laser is equipped to illuminate a beam which when directed at the alignment mark illuminates the mark thereby indicating a proper spot of said rack for positioning the same on the table and wherein said rack includes a bored surface extending from one side through to another side of said rack to receive said laser therethrough, said laser having biasing means extending inward into said inner area of said rack which is biased inwardly by a billiard ball upon insertion of billiard balls into said rack thereby activating said laser such that said beam can illuminate outwardly from said rack and wherein when said balls are removed from said rack said beam is automatically shut off by virtue of said biasing means relaxing to an off position within said inner area.

7. The billiard rack laser system of claim 6, wherein said rack includes multiple lasers emitting a plurality of laser beams for positioning said rack.

8. The billiard rack laser system of claim 6, wherein said bored surface extends through a corner of said rack.

9. The billiard rack laser system of claim 7, wherein said pool table has a pair of alignment marks disposed on opposite sides of said table and said beams can illuminate said pair of alignment marks indicating a proper division line for spot of a cue ball for positioning the same on said table.

* * * * *